US011974594B2

(12) United States Patent
Rosado

(10) Patent No.: US 11,974,594 B2
(45) Date of Patent: May 7, 2024

(54) HOMOGENIZED TOBACCO MATERIAL PRODUCTION LINE AND METHOD FOR INLINE PRODUCTION OF HOMOGENIZED TOBACCO MATERIAL

(71) Applicant: PHILIP MORRIS PRODUCTS S.A., Neuchatel (CH)

(72) Inventor: Francisco Rosado, Rio de Mouro (PT)

(73) Assignee: Philip Morris Products S.A., Neuchatel (CH)

( * ) Notice: Subject to any disclaimer, the term of this patent is extended or adjusted under 35 U.S.C. 154(b) by 205 days.

(21) Appl. No.: 15/777,682

(22) PCT Filed: Nov. 25, 2016

(86) PCT No.: PCT/EP2016/078822
§ 371 (c)(1),
(2) Date: May 21, 2018

(87) PCT Pub. No.: WO2017/089545
PCT Pub. Date: Jun. 1, 2017

(65) Prior Publication Data

US 2018/0368465 A1 Dec. 27, 2018

(30) Foreign Application Priority Data

Nov. 27, 2015 (EP) ..... 15196674

(51) Int. Cl.
*A24B 3/14* (2006.01)
*A24B 3/08* (2006.01)
(Continued)

(52) U.S. Cl.
CPC ..... *A24B 3/14* (2013.01); *A24B 3/08* (2013.01); *A24B 7/00* (2013.01); *A24B 15/303* (2013.01); *A24C 5/01* (2020.01); *A24C 5/18* (2013.01)

(58) Field of Classification Search
CPC ..... A24B 3/14
(Continued)

(56) References Cited

U.S. PATENT DOCUMENTS 3,310,058 A * 3/1967 Savage ..... A24B 15/14 131/355
4,000,748 A 1/1977 Summers
(Continued)

FOREIGN PATENT DOCUMENTS

CN 104602551 5/2015
CN 204763381 11/2015
(Continued)

OTHER PUBLICATIONS

Smook, Gary A., "Handbook for Pulp and Paper Technologists", 1992, Angus Wilde Publications, Vancouver, BC. Chapter 13, pp. 194-208. (Year: 1992).*
(Continued)

*Primary Examiner* — Michael J Felton
(74) *Attorney, Agent, or Firm* — Mueting Raasch Group

(57) ABSTRACT

The invention relates to a homogenized tobacco sheet production line comprising: A tank (501) adapted to contain a slurry formed by a tobacco powder blend, a binder (6) and an aerosol former (5) in an aqueous medium; A cast apparatus (200) adapted to receive slurry from the tank (501) and to cast the slurry so as to form a homogenized tobacco material; A movable transporting support (606) on which said slurry is casted and adapted to transport the homogenized tobacco material along a transport direction; A slitter (611) located downstream the cast apparatus (200) adapted to slit the homogenized tobacco material along the transport direction so as to form portioned homogenized tobacco sheets; and A crimper (613) located downstream the slitter (611) adapted to receive at least one of the partial homog-
(Continued)

enized tobacco sheets from the slitter (611) and to crimp the at least one of the portioned homogenized tobacco sheets. It also relates to a method for inline production of a homogenized tobacco sheet.

5 Claims, 9 Drawing Sheets

(51) Int. Cl.

| | |
|---|---|
| ***A24B 7/00*** | (2006.01) |
| ***A24B 15/30*** | (2006.01) |
| ***A24C 5/01*** | (2020.01) |
| ***A24C 5/18*** | (2006.01) |

(58) Field of Classification Search
USPC ..... 131/372
See application file for complete search history.

(56) References Cited

U.S. PATENT DOCUMENTS

| | | | | |
|---|---|---|---|---|
| 4,306,578 | A * | 12/1981 | Schmidt | A24B 15/30 131/353 |
| 4,542,755 | A | 9/1985 | Selke | |
| 6,409,372 | B1 | 6/2002 | Peters | |
| 8,136,533 | B2 | 3/2012 | Monsalud | |
| 10,051,882 | B2 | 8/2018 | Nakagawa | |
| 2007/0084476 | A1* | 4/2007 | Yang | A24B 3/14 131/372 |
| 2017/0258126 | A1* | 9/2017 | Klipfel | A24B 15/14 |
| 2018/0368465 | A1 | 12/2018 | Rosado | |

FOREIGN PATENT DOCUMENTS

| | | |
|---|---|---|
| EP | 0150473 | 8/1985 |
| EP | 2526787 | 11/2012 |
| JP | 62000264 | 1/1987 |
| JP | 54-140798 | 10/2002 |
| JP | 54-140798 | 1/2003 |
| JP | 2008-193966 | 8/2008 |
| JP | 45-40277 | 7/2010 |
| JP | 2019-502366 | 1/2019 |
| RU | 2346629 | 2/2009 |
| SU | 277601 | 7/1970 |
| WO | WO 2012/164009 | 12/2012 |
| WO | WO 2015/082654 | 6/2015 |
| WO | WO 2015/173275 | 11/2015 |
| WO | WO 2015/177252 | 11/2015 |

OTHER PUBLICATIONS

AFT Global, "Introduction to Stock Prep Refining", 2016, AFT Global, accessed via: https://aft-global.com/sites/default/files/resources/docs/files/2017-03/EB-050-ENA4_FineBar%20Training%20Manual%202016_A4.pdf (Year: 2016).*

Lumiainen, J. (2000). Refining of chemical pulp, in Papermaking Part 1, Stock Preparation and Wet End, (Paulapuro, H., Ed.), pp. 86-122, Papermaking (Year: 2000).*

PCT Search Report and Written Opinion for PCT/EP2016/078822 dated Mar. 14, 2017 (13 pages).

Office Action issued in Russia for Application No. 2018121628 dated Dec. 19, 2019 (17 pages). English translation included.

Office Action issued in Japan for Application No. 2018-522621 dated May 20, 2021 (6 pages). English translation included.

Office Action issued in Japan for Application No. 2022-016124 dated Mar. 6, 2023 (14 pages). English translation included.

Office Action issued in Japan for Application No. 2022-016124 dated Jul. 27, 2023 (9 pages). English translation included.

* cited by examiner

HOMOGENIZED TOBACCO MATERIAL PRODUCTION LINE AND METHOD FOR INLINE PRODUCTION OF HOMOGENIZED TOBACCO MATERIAL

This application is a U.S. National Stage Application of International Application No. PCT/EP2016/078822 filed Nov. 25, 2016, which was published in English on Jun. 1, 2017, as International Publication No. WO 2017/089545 Al. International Application No. PCT/EP2016/078822 claims priority to European Application No. 15196674.4 filed Nov. 27, 2015.

This invention relates to an apparatus and a method for inline production of homogenized tobacco material. In particular, the invention relates to an apparatus and a process for producing homogenized tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore it is important to have good control over the composition of the homogenized tobacco material, for the control for example, of the taste of the aerosol. The use of tobacco dust or leftovers from other tobacco productions for the production of homogenized tobacco material for aerosol-generating article is therefore less suitable because the exact composition of the tobacco dust is not known.

This homogenized tobacco material is rather "sticky" and has a generally relatively low tensile strength. Therefore, during its production, it needs to be handled with care due to the fact that, if mishandled, it may tear or break easily, or it can change its characteristics consequently altering the flavour or characteristics of the aerosol obtained when used in an aerosol-generating article.

There is therefore a need for a new method and apparatus for producing a homogenized tobacco material for the use in a heated aerosol-generating article of the "heat-not-burn" type that is adapted to the different heating characteristics and aerosol forming needs of such a heated aerosol-generating article, so that the homogenized tobacco material is properly handled and an optimal aerosol can be formed.

The invention refers to a homogenized tobacco sheet production line comprising: a tank adapted to contain a slurry formed by a tobacco powder blend, a binder and an aerosol former in an aqueous medium; a cast apparatus adapted to receive slurry from the tank and to cast the slurry so as to form a homogenized tobacco material; a movable transporting support on which said slurry is casted and adapted to transport the homogenized tobacco material along a transport direction; a slitter located downstream the cast apparatus adapted to slit the homogenized tobacco material along the transport direction so as to form portioned homogenized tobacco sheets; and a crimper located downstream the slitter adapted to receive at least one of the partial homogenized tobacco sheets from the slitter and to crimp the at least one of the portioned homogenized tobacco sheets.

Slitting the homogenized tobacco sheet after casting and crimping it afterwards allows avoiding the realization of a "master bobbin" having a width substantially equal to the width of the cast sheet. The master bobbin needs to be stored under special moisture and temperature conditions so as not to alter the homogenized tobacco sheet characteristics. Further, an unwinding step of the master bobbin is also required, during which the wound homogenized tobacco sheet can easily crack or break. This unwinding step of the master bobbin with the invention is avoided. There is no bobbins formation in the invention, the homogenized tobacco sheet after casting is immediately processed and crimped. From the crimper, the crimped portioned tobacco sheet may immediately proceed to a rod forming station.

Homogenized tobacco materials are formed by mixing several ingredients with water to obtain a slurry. In a further step, a continuous web of homogenized material is created on a support by casting the slurry onto the support. It is desired that the resulting homogenized tobacco material has a relatively high tensile strength and a good homogeneity.

The term "homogenized tobacco material" is used throughout the specification to encompass any tobacco material formed by the agglomeration of particles of tobacco material. Sheets or webs of homogenized tobacco are formed in the present invention by agglomerating particulate tobacco obtained by grinding or otherwise powdering of one or both of tobacco leaf lamina and tobacco leaf stems.

In addition, homogenized tobacco material may comprise a minor quantity of one or more of tobacco dust, tobacco fines, and other particulate tobacco by-products formed during the treating, handling and shipping of tobacco.

Homogenized tobacco material may comprise one or more intrinsic binders, one or more extrinsic binders, or a combination thereof to help agglomerate particles of tobacco. Homogenized tobacco material may comprise other additives including, but not limited to, tobacco and non-tobacco fibres, aerosol-formers, humectants, plasticisers, flavourants, fillers, aqueous and non-aqueous solvents, and combinations thereof.

In the present invention, the slurry is formed by tobacco lamina and stem of different tobacco types, which are properly blended. With the term "tobacco type" one of the different varieties of tobacco is meant. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

An important parameter of the slurry which is used to realize the homogenized tobacco material and which influences the tensile strength and homogeneity of the cast web is its viscosity to form the continuous web of homogenized tobacco material, in particular at the time of casting of the slurry. In addition, also the density of the slurry is important for determining the end quality of the cast web, in particular before casting. A proper slurry density, viscosity and homogeneity minimize the number of defects and maximize tensile strength of the cast web.

The slurry comprises in addition to the tobacco powder blend a cellulose pulp containing cellulose fibers is preferably added to the slurry in order to increase the tensile strength of the tobacco material web, acting as a strengthening agent. A binder and an aerosol-former are preferably added as well, in order to enhance the tensile properties of the homogenized sheet and promote the formation of aerosol. Further, in order to reach a certain viscosity and moisture optimal for casting the web of homogenized tobacco material, water may be added to the slurry. The slurry is mixed in order to render it as homogeneous as possible.

The slurry is then collected in a cast apparatus, for example including a casting box, in which a pre-defined amount of slurry is preferably maintained, for example a pre-determined level of slurry within the casting box is set. Preferably, slurry is continuously supplied to the casting box while the slurry is cast onto a movable support to form a continuous web of homogenized tobacco material.

According to the invention, the slurry is cast by means of the cast apparatus across the width of a moving transporting support. For example, the casting may take place by means of a casting blade. The transporting support moves along a longitudinal or transport direction in order to remove the slurry from the cast apparatus. The support may include for example a stainless steel movable belt. The cast apparatus is preferably so designed and construed to form a cast web of slurry which has a substantially uniform thickness onto the movable support.

The cast homogenized tobacco sheet has a width, which is defined as its dimension substantially perpendicular to the transport direction of the movable support, which is preferably determined by a compromise between two antagonist requests. Preferably, the moisture of the sheet needs to be kept substantially uniform and controlled in order to obtain an end product with a limited number of defects, and in addition there is a need to obtain a production rate as high as possible. A proper moisture control would reduce a selected value for the width of the sheet, because a relatively "small width" allows a proper uniformity in the moisture level in particular during a drying step, while increasing the production rate would demand for an increase of the width of the sheet. Therefore, preferably the width of the sheet is as wide as a proper control of its moisture allows.

Preferably, the width of the cast homogenized tobacco sheet is of about 1.930 meters at casting.

After casting, the so formed homogenized tobacco sheet or web is directly fed to a slitter located downstream the cast apparatus. The slitter is adapted to divide the cast tobacco web in multiple parts along the transport direction. Thus, downstream the slitter, the tobacco web is divided longitudinally in parallel sections of tobacco web. The result downstream the slitter is a plurality of portioned tobacco sheets having each a width smaller than the initial width of the cast tobacco sheet.

In the present contest "downstream" and "upstream" refers to the transport direction of the tobacco web onto the moving support. Therefore a first object is "downstream" a second object if, during its movement on the support, the homogenized tobacco web reaches the first object first and then the second object.

The sum of the plurality of widths of the portioned tobacco sheets is equal to the initial width of the cast tobacco sheet. The widths of the portioned tobacco sheets slit by the slitter can be substantially identical, that is the cast tobacco sheet is divided in substantially identical portioned sheets, or the widths of the different portioned tobacco sheets may differ one from the others. The widths values are selected depending on the final use of the portioned tobacco sheet, that is, preferably they depend on the characteristics of the aerosol generating article where a part of the portioned tobacco sheet is used.

Preferably, the width of a portioned tobacco sheet is comprised between about 0.05 meters and about 0.5 meters.

Downstream of the slitter, a crimper or crimping station is located. The crimping station receives at least one of the portioned tobacco sheets in order to crimp the same. The size of the bobbin is relatively "small", due to the fact that the width of the portioned tobacco sheet is also relatively small.

As used herein, the term 'crimped sheet' is intended to be synonymous with the term 'creped sheet' and denotes a sheet having a plurality of substantially parallel ridges or corrugations. The crimper may include for example a couple of rollers between which the portioned homogenized tobacco sheet is introduced. The crimper used in the present invention may be a crimper know in the art, preferably a tobacco crimper. A suitable crimper is for example the crimper described in the Swiss patent CH 691156. According to the invention, there is no formation of "master bobbin" having a width equal to the width of the cast homogenized tobacco sheet. The cast tobacco sheet is cut into smaller sheets having smaller widths than the width of the sheet at casting, therefore avoiding the step of forming a master bobbin which needs special storage conditions before it is further cut. No bobbin at all is realized, avoiding their storage and a further unwinding step. The portioned tobacco sheets are processed immediately by means of a crimper so that the crimped homogenized tobacco sheet can for example directly be further processed to produce components of aerosol-generating articles.

Further, the cast homogenized tobacco sheet is rather sticky and with relatively low tensile strength, due to its composition. Forming bobbins of this "sticky" sheet may cause problems of storage and further handling.

Preferably, the homogenized tobacco sheet production line according to the invention comprises a drying station located downstream the cast apparatus and upstream said slitter adapted to dry the homogenized sheet. A web of homogenized tobacco material is formed by a cast apparatus which is adapted to cast a slurry prepared including the blend of tobacco powder above described on a support surface of the moving support. Preferably, the cast tobacco web is then dried in a drying station to form a sheet of homogenized tobacco material. Preferably, the moisture of said cast tobacco web at casting is between about 60 percent and about 80 percent in weight of the total weight of the homogenized tobacco sheet. Preferably, the moisture of said cast tobacco web at the winding station is between about 7 percent and about 15 percent of the total weight of the tobacco material web. Preferably, the moisture of said homogenized tobacco web at winding is between about 8 percent and about 12 percent of the total weight of the homogenized tobacco web. The difference between the moisture at casting and the moisture at winding is preferably for most part removed at the drying station.

Preferably, said slitter is located directly downstream said drying station. After the drying station, the cast homogenized tobacco sheet has the right density or consistency, due to the amount of remaining moisture, to be properly cut in parallel sheets. A different moisture content, which might be present in different location of the production line, may cause difficulties in cutting the sheet, which may break at the edges where the cut is performed.

Preferably, the crimper is located directly downstream the slitter. The portioned tobacco sheet is therefore crimped as soon as it is cut. The crimped homogenized tobacco sheet can be then further processed.

Preferably, the movable transporting support includes a single continuous moving support transporting the homogenized tobacco sheet from the cast apparatus to the slitter. The homogenized tobacco sheet downstream the cast apparatus remains on the support from the cast apparatus, preferably also through the drying station, till the slitter is reached. No doctoring of the sheet from the support is needed when a single moving support is used. As mentioned, the homogenized tobacco sheet is relatively fragile and breaks easily; doctoring of the sheet may be a cause of tears or breakage of the sheet. Avoiding the removal from the support of the sheet may limit the possibility of breakage of the sheet.

Advantageously, the homogenized tobacco sheet production line comprises a rod forming unit downstream the crimper. At the end of the production line, a finished product to be used in an aerosol-generating article is obtained. The storage of semi-finished components is therefore minimized and the number of steps of the whole process to obtain the finished product is minimized.

Preferably, the slitter includes at least two blades, so as to form at least three partial homogenized tobacco sheets. The cast sheet after drying has preferably a width of between 2 meters and about 1.5 meters in order to achieve a relatively high production speed. It is preferred to form bobbins having a width of the wound sheet comprised between about 0.05 meters and about 0.5 meters for a proper handling and therefore it is preferred that at least three portioned homogenized tobacco sheets are formed by the slitter.

Preferably, the homogenized tobacco sheet production line includes a number of crimpers equal to the number of portioned homogenized tobacco sheet slit by the slitter. More preferably, the homogenized tobacco sheet production line includes a number of rod forming units equal to the number of portioned homogenized tobacco sheets slit by the slitter. Downstream the slitter, preferably all the portioned tobacco sheets are processed, either crimped, or crimped and then from the crimped homogenized tobacco sheets rods to be used in an aerosol-generating article are formed. The production speed is increased.

The invention also relates to a method for inline production of homogenized tobacco material, said method comprising: preparing a slurry comprising tobacco powder blend, a binder and an aerosol former in an aqueous medium; casting the slurry in a support movable along a transport direction to form a homogenized tobacco sheet; slitting the homogenized tobacco sheet along said transport direction while the homogenized tobacco sheet is moved along the transport direction so as to form portioned homogenized tobacco sheets; and crimping at least one slit portioned homogenized tobacco sheet in a bobbin.

The term "inline" refers to a linked sequence of manufacturing processes. The steps of the method of the invention are performed one after the other or contemporarily, in a continuous manner. There is no process interruption between one step and the others.

The advantages of the method have been already outlined above, that is, an inline production of crimped portioned homogenized tobacco sheets instead of a "master bobbin" having a width equal to the width of the cast sheet of homogenized material, so that any storage of bobbins or semi-finished products is minimized. Ù

Preferably, the method includes forming a rod from each crimped portioned homogenized tobacco sheet.

Advantageously, the step of slitting the homogenized tobacco sheet includes the step of slitting the homogenized tobacco sheet in at least three portioned homogenized tobacco sheets.

Advantageously, the step of preparing a slurry comprises: creating a cellulose pulp from cellulose fibers and water, providing a tobacco powder blend; and combining the cellulose pulp, the tobacco powder blend, a binder and aerosol-former to form said slurry. According to the invention, the binder and the aerosol-former are pre-mixed in order to form a suspension and then combined with the cellulose pulp and tobacco powder blend. Homogenized tobacco materials are formed by mixing several ingredients with water to obtain a slurry and then, for example by casting the slurry, creating a continuous web of homogenized material on a support. It is desired that the resulting of homogenized tobacco material has a relatively high tensile strength and a good homogeneity.

A reduced tensile strength of the homogenized tobacco sheet may lead to difficulties in subsequent handling of the homogenized tobacco web in the production of the aerosol-generating article and could for example cause machine stops. Additionally, an inhomogeneous tobacco web may create unintended difference in the aerosol delivery between aerosol generating articles that are produced from the same homogenized tobacco web.

Further, another important parameter of the slurry which is used to realize the homogenized tobacco material is its viscosity, in particular at the time of casting or otherwise forming the continuous web of tobacco. Viscosity influences the tensile strength of the homogenized tobacco web and its uniformity. The density of the slurry, in particular before a step of casting the slurry to form a homogenized tobacco web, is important for determining the end quality of the web itself. A proper slurry density and homogeneity minimizes the number of defects and maximizes tensile strength of the web.

The slurry comprises a number of components to produce the homogenized tobacco web. These components influence the homogenized tobacco material properties. A first ingredient is a tobacco powder blend, which preferably contains the majority of the tobacco present in the slurry. The tobacco powder blend is the source of the majority of tobacco in the homogenized tobacco material and thus gives the flavor to the aerosol. A cellulose pulp containing cellulose fibers is added in order to increase the tensile strength of the tobacco material web, acting as a strengthening agent. A binder and an aerosol-former are added as well, in order to enhance the tensile properties of the homogenized sheet and promote the formation of aerosol. Further, in order to reach a certain viscosity and moisture optimal for casting a web of homogenized tobacco material, water is added to the slurry.

However, binders when in contact with water may gel and the gel cross-linking prevents a further uniform dispersion of the binder in the slurry, preventing to achieve the required slurry homogeneity and viscosity.

According to the invention, a pre-mixing between the binder and the aerosol-former is performed, so that the contact—and therefore the gel formation—between the water and the binder is delayed as much as possible. The suspension which is formed between the binder and the aerosol-former delays the formation of the gel when the suspension formed by the binder and the aerosol-former is combined with water. Without being bound by theory, the aerosol-former molecules delay the formation of the hydrogen bonds. In other words, the aerosol-former at least partially inhibits the cross linking of binder and water by positioning between the water and binder molecules.

A cellulose pulp includes water and cellulose fibres. Tobacco itself includes naturally cellulose fibres. The cellulose fibres of the pulp are added to the slurry in addition to those cellulose fibres contained in the tobacco blend and are called in the following "added" cellulose fibres. Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the added cellulose fibres might be subjected to suitable processes such as refining, mechanical pulping, chemical pulping, bleaching, sulphate pulping and combination thereof.

Fibres particles may include tobacco stem materials, stalks or other tobacco plant material. Preferably, cellulose-based fibres such as wood fibres comprise a low lignin content. Fibres particles may be selected based on the desire to produce a sufficient tensile strength. Alternatively fibres, such as vegetable fibres, may be used either with the above fibres or in the alternative, including hemp and bamboo.

The addition of a binder, such as any of the gums or pectins described herein, facilitates that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Slurry for the production homogenized tobacco material may comprise other ingredients or additives in addition to the above mentioned list. For example, the slurry may include, but not limited to, tobacco fibres, plasticisers, flavourants, fillers, aqueous and non-aqueous solvents, and combinations thereof.

According to the invention, the method for producing the slurry for the production of homogenized tobacco material includes a step of pre-mixing the aerosol-former and the binder, such as for example guar and glycerol, so that the two form a suspension, at least partially. A suspension is a heterogeneous mixture in which solute-like particles settle out of a solvent-like phase sometime after their introduction.

The suspension between aerosol-former and binder is performed in absence of water. In this context "the absence of water" is understood that the water content of the suspension of binder in aerosol-former is smaller than about 1 percent of the total weight of the suspension.

After the pre-mixing phase and suspension of binder in the aerosol-former, the slurry, according to the method of the invention, is formed.

The slurry is formed combining all the above mentioned elements together: the suspension of binder in aerosol-former, the pulp, and the tobacco powder blend. In the slurry formation, the binder enters in contact with water due to the fact that pulp contains water. When in contact with water, an aging process starts, where some gel may form and the viscosity of the slurry changes continuously. However, the binder in the suspension takes more time to form gel than without being pre-mixed in a suspension with the aerosol-former. Therefore, there is more time for mixing and rendering the slurry as uniform and homogeneous as possible before forming a homogenized tobacco web, for example by means of a casting step.

Preferably, the step of preparing a slurry comprises the steps of pulping and refining cellulose fibres so as to form a pulp and grinding a blend of tobacco of one or more tobacco types. In a further step, a slurry is formed by combining the tobacco blend powder of different tobacco types with the pulp and a binder. A further step comprises homogenizing the slurry, and forming a homogenized tobacco material from the slurry. According to the invention, the pulping and refining step outputs cellulose fibres having a mean size between about 0.2 millimetres and about 4 millimetres. The grinding step produces a tobacco powder blend having a mean size comprised between about 0.03 millimetres and about 0.12 millimetres. The binder is added in the slurry in an amount between about 1 percent and about 5 percent in dry weight basis of the total weight of the homogenized tobacco sheet.

As the tobacco present in the homogenized tobacco material constitutes substantially the only—or the majority of—tobacco present in the aerosol-generating article, the impact on the characteristics of the aerosol, such as its flavour, derives predominantly from the homogenized tobacco material. It is preferred that the release of substances from the tobacco present in the homogenized tobacco material is simplified, in order to optimize use of tobacco. According to the invention, the tobacco powder is—at least for a fraction of the total tobacco powder amount—of the same size or below the size of the tobacco cell structure. It is believed that fine grinding tobacco to about 0.05 millimetres can advantageously open the tobacco cell structure and in this way the aerosolization of tobacco substances from the tobacco itself is improved. Examples of substances for which the aerosolization may be improved by providing tobacco powder with a mean powder size between about 0.03 millimetres and about 0.12 millimetres are pectin, nicotine, essential oils and other flavours. In the following, the term "tobacco powder" is used through the specification to indicate tobacco having a mean size between about 0.03 millimetres and about 0.12 millimetres.

The same mean size of the tobacco powder between about 0.03 millimetres and about 0.12 millimetres may also improve the homogeneity of the slurry. Too big tobacco particles, that is, tobacco particles bigger than about 0.15 millimetres, may be the cause of defects and weak areas in the homogenized tobacco web which is formed from the slurry. Defects in the homogenized tobacco web may reduce the tensile strength of the homogenized tobacco web. A reduced tensile strength may lead to difficulties in subsequent handling of the homogenized tobacco web in the production of the aerosol-generating article and could for example cause machine stops. Additionally, an inhomogeneous tobacco web may create unintended difference in the aerosol delivery between aerosol generating articles that are produced from the same homogenized tobacco web. Therefore, a tobacco having relatively small mean particle size is desired as a starting tobacco material to form the slurry to obtain acceptable homogenized tobacco material for aerosol-generating articles. Too small tobacco particles increases the energy consumption required in the process for their size reduction without adding advantages for this further reduction.

A reduced tobacco powder mean size is also beneficial due to its effect on reducing the viscosity of the tobacco slurry, thereby allowing a better homogeneity. However, at the size between about 0.03 millimetres and about 0.12 millimetres, the tobacco cellulose fibres within the tobacco powder are substantially destroyed. Therefore, the tobacco cellulose fibres within the tobacco powder may have only a very small contribution to the tensile strength of the resulting homogenized tobacco web. Conventionally, this is compensated by the addition of binders. Nevertheless, there is a practical limit to the amount of binders that may be present in the slurry and hence in the homogenized tobacco material. This is due to the tendency of the binders to gel when coming in contact with water. Gelling strongly influences the viscosity of the slurry, which in turn is an important parameter of the slurry for subsequent web manufacturing processes, like for example casting. It is therefore preferred to have a relatively low amount of binder in the homogenized tobacco material. According to the invention, the quantity of binder added to the blend of one or more tobacco types is comprised between about 1 percent and about 5 percent in dry weight of the slurry. The binder used in the slurry can be any of the gums or pectins described herein. The binder may ensure that the tobacco powder remains substantially dispersed throughout the homogenized tobacco web. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

Although on one hand the relatively small tobacco powder mean size and the reduced amount of binder may result in a very homogeneous slurry and then in a very homogeneous homogenized tobacco material, on the other hand the tensile strength of the homogenized tobacco web obtained from this slurry may be relatively low and potentially insufficient to adequately withstand the forces acting on the homogenized tobacco material during processing.

According to the invention, cellulose fibres are introduced in the slurry. Those cellulose fibres are added to the cellulose fibres present within the tobacco itself, that is to say, the cellulose fibres herein mentioned are fibres other than the fibres naturally present in the tobacco blend powder and they are called in the following "added cellulose fibres". The introduction of cellulose fibres in the slurry increases the tensile strength of the tobacco material web, acting as a strengthening agent. Therefore, adding cellulose fibres in addition to those already present in the tobacco may increase the resilience of the homogenized tobacco material web. This supports a smooth manufacturing process and subsequent handling of the homogenized tobacco material during the manufacture of aerosol generating articles. In turn, this can lead to an increase in production efficiency, cost efficiency, reproducibility and production speed of the manufacture of the aerosol-generating articles and other smoking articles.

Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof.

Fibres particles may include tobacco stem materials, stalks or other tobacco plant material. Preferably, cellulose-based fibres such as wood fibres comprise a low lignin content. Alternatively fibres, such as vegetable fibres, may be used either with the above fibres or in the alternative, including hemp and bamboo.

One relevant factor in the added cellulose fibres is the cellulose fibre length. Where the cellulose fibres are too short, the fibres would not contribute efficiently to the tensile strength of the resulting homogenized tobacco material. Where the cellulose fibres are too long, the cellulose fibres would impact the homogeneity in the slurry and in turn may create inhomogeneties and other defects in the homogenized tobacco material, in particular for thin homogenized tobacco material, for example with a homogenized tobacco material with a thickness of several hundreds of micrometres. According to the invention, the size of added cellulose fibres in a slurry comprising tobacco powder having a mean size between about 0.03 millimetres and about 0.12 millimetres and a quantity of binder between about 1 percent and about 5 percent in dry weight of the slurry, is advantageously between about 0.2 millimetres and about 4 millimetres. Preferably, the mean size of the cellulose fibres is between about 1 millimetre and about 3 millimetres. Preferably, this further reduction is obtained by means of a refining step. In the present specification, the fibre "size" means the fibre length, that is, the fibre length is the dominant dimension of the fibre. Thus, mean fibre size has the meaning of mean fibre size length. The mean fiber length is the mean fiber length per a given number of fibers, excluding fibers having a length below about 200 microns or above about 10.000 microns and excluding fibers having a width below about 5 microns or above about 75 microns. Further, preferably, according to the invention, the amount of the cellulose fibres added to the cellulose fibres present in the tobacco powder blend is comprised between about 1 percent and about 3 percent in dry weight basis of the total weight of the slurry. These values of the ingredients of the slurry have shown to improved tensile strength while maintaining a high level of homogeneity of the homogenized tobacco material compared to homogenized tobacco material that only relies on binder to address tensile strength of the homogeneous tobacco web. At the same time, cellulose fibres having a mean size, for example a mean length, between about 0.2 millimetres and about 4 millimetres do not significantly inhibit the release of substances from the fine ground tobacco powder when the homogenized tobacco material is used as an aerosol generating substrate of an aerosol generating article. According to the invention, a relatively fast and reliable manufacturing process of homogenized tobacco web can be obtained, as well as a substrate that is adapted to release a highly reproducible aerosol.

Further, the invention relates to an aerosol-generating article including a portion of the homogenized tobacco material above described. An aerosol-generating article is an article comprising an aerosol-forming substrate that is capable of releasing volatile compounds that can form an aerosol. An aerosol-generating article may be a non-combustible aerosol-generating article. Non-combustible aerosol-generating article releases volatile compounds without the combustion of the aerosol-forming substrate, for example by heating the aerosol-forming substrate, or by a chemical reaction, or by mechanical stimulus of an aerosol-forming substrate.

The aerosol-forming substrate is capable of releasing volatile compounds that can form an aerosol volatile compound and may be released by heating the aerosol-forming substrate. In order for the homogenized tobacco material to be used in an aerosol-forming generating article, aerosol formers are preferably included in the slurry that forms the cast leaf. The aerosol formers may be chosen based on one or more of predetermined characteristics. Functionally, the aerosol former provides a mechanism that allows the aerosol former to be volatilize and convey nicotine and/or flavouring in an aerosol when heated above the specific volatilization temperature of the aerosol former.

Specific embodiments will be further described, by way of example only, with reference to the accompanying drawings in which.

Figure 1:
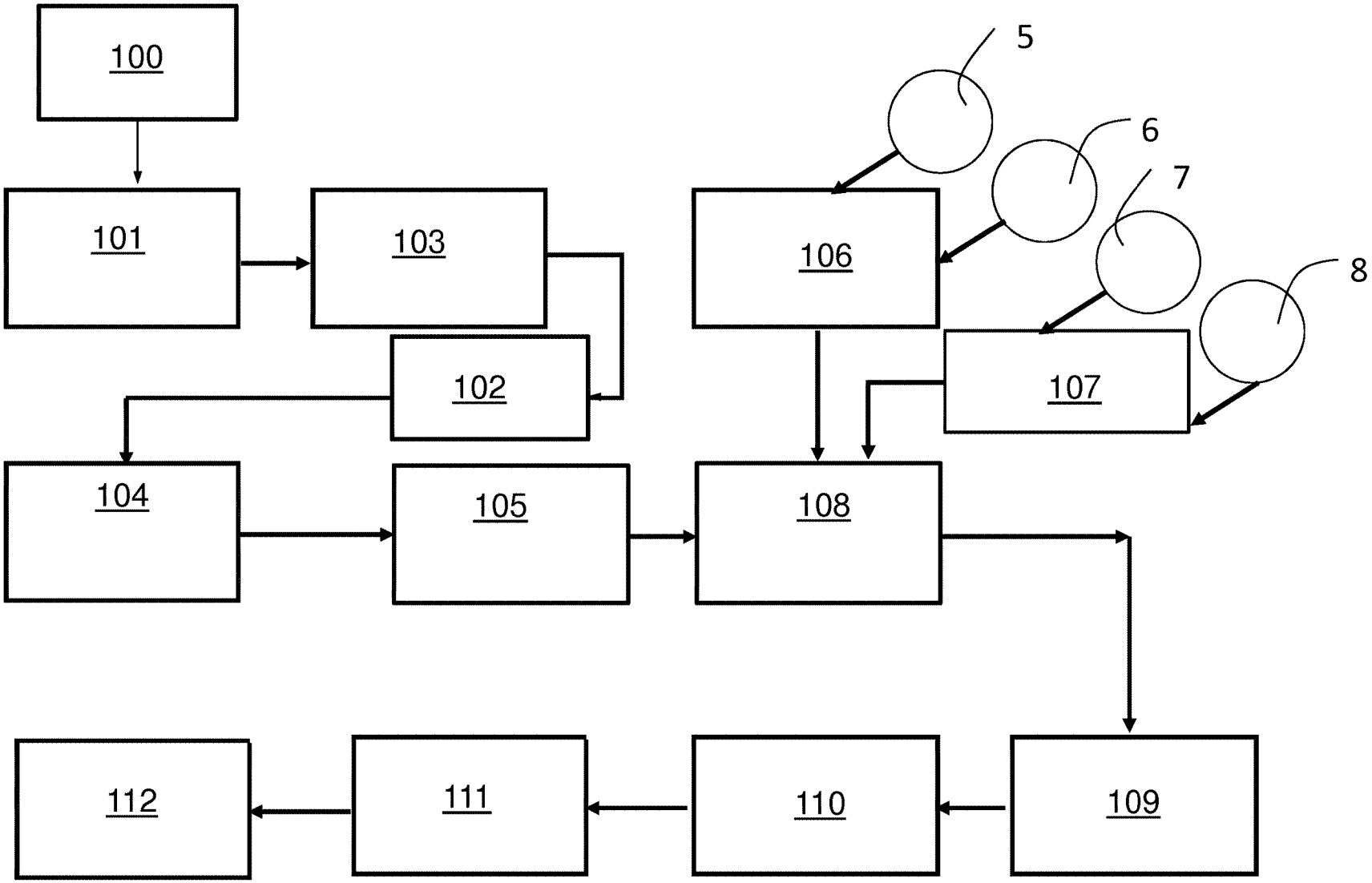
FIG. 1 shows a flow diagram of a method to produce slurry for homogenized tobacco material according to the invention.

With initial reference to FIG. 1, a method for the production of slurry according to the present invention is represented. The first step of the method of the invention is the selection 100 of the tobacco types and tobacco grades to be used in the tobacco blend for producing the homogenized tobacco material. Tobacco types and tobacco grades used in the present method are for example bright tobacco, dark tobacco, aromatic tobacco and filler tobacco.

Only the selected tobacco types and tobacco grades intended to be production of the used for the homogenized tobacco material undergo the processing according to following steps of the method of the invention.

The method includes a further step 101 in which the selected tobacco is laid down. This step may comprise checking the tobacco integrity, such as grade and quantity, which can be for example verified by a bar code reader for product tracking and traceability. After harvesting and curing, the leaf of tobacco is given a grade, which describes for example the stalk position, quality, and colour.

Further, the lay down step 101 might also include, in case the tobacco is shipped to the manufacturing premises for the production of the homogenized tobacco material, de-boxing or case opening of the tobacco boxes. The de-boxed tobacco is then preferably fed to a weighing station in order to weight the same.

Moreover, the tobacco lay down step 101 may include bale slicing, if needed, as the tobacco leaves are normally compressed into bales in shipping boxes for shipping.

The following steps are performed for each tobacco type, as detailed below. These steps may be performed subsequently per grade such that only one production line is required. Alternatively, the different tobacco types may be processed in separate lines. This may be advantageous where the processing steps for some of the tobacco types are different. For example, in conventional primary tobacco processes bright tobaccos and dark tobaccos are processed at least partially in separate processes, as the dark tobacco often receives an additional casing. However, according to the present invention, preferably, no casing is added to the blended tobacco powder before formation of the homogenized tobacco web.

Further, the method of the invention includes a step 102 of coarse grinding of the tobacco leaves.

According to a variant of the method of the invention, after the tobacco lay down step 101 and before the tobacco coarse grinding step 102, a further shredding step 103 is performed, as depicted in FIG. 1. In the shredding step 103 the tobacco is shredded into strips having a mean size comprised between about 2 millimetres and about 100 millimetres.

Preferably, after the shredding step 103, a step of removal of non-tobacco material from the strips is performed (not depicted in FIG. 1).

Subsequently, the shredded tobacco is transported towards the coarse grinding step 102. The flow rate of tobacco into a mill to coarse grind the strips of tobacco leaf is preferably controlled and measured.

In the coarse grinding step 102, the tobacco strips are reduced to a mean particle size of between about 0.25 millimetres and about 2 millimetres. At this stage, the tobacco particles are still with their cells substantially intact and the resulting particles do not pose relevant transport issues.

Preferably, after the coarse grinding step 102, the tobacco particles are transported, for example by pneumatic transfer, to a blending step 104. Alternatively, the step of blending 104 could be performed before the step of coarse grinding 102, or where present, before the step of shredding 103, or, alternatively, between the step of shredding 103 and the step of coarse grinding 102.

In the blending step 104, all the coarse grinded tobacco particles of the different tobacco types selected for the tobacco blend are blended. The blending step 104 therefore is a single step for all the selected tobacco types. This means that after the step of blending there is only need for a single process line for all of the different tobacco types.

In the blending step 104, preferably mixing of the various tobacco types in particles is performed. Preferably a step of measuring and controlling one or more of the properties of the tobacco blend is performed. According to the invention, the flow of tobacco may be controlled such that the desired blend according to a pre-set target value or pre-set target values is obtained. For example, it may be desirable that the blend includes bright tobacco 1 at least for about 30 percent in dry weight of the total tobacco in the blend, and that dark tobacco 2 and aromatic tobacco 3 are comprised each in a percentage between about 0 percent and about 40 percent in dry weight basis of the total tobacco in the blend, for example about 35 percent. More preferably, also filler tobacco 4 is introduced in a percentage between about 0 percent and about 20 percent in dry weight basis of the total tobacco in the blend. The flow rate of the different tobacco types is therefore controlled so that this ratio of the various tobacco types is obtained. Alternatively, where the coarse grinding step 102 is done subsequently for the different tobacco leafs used, the weighing step at the beginning of the step 102 determines the amount of tobacco used per tobacco type and grade instead of controlling its flow rate.

Figure 2:
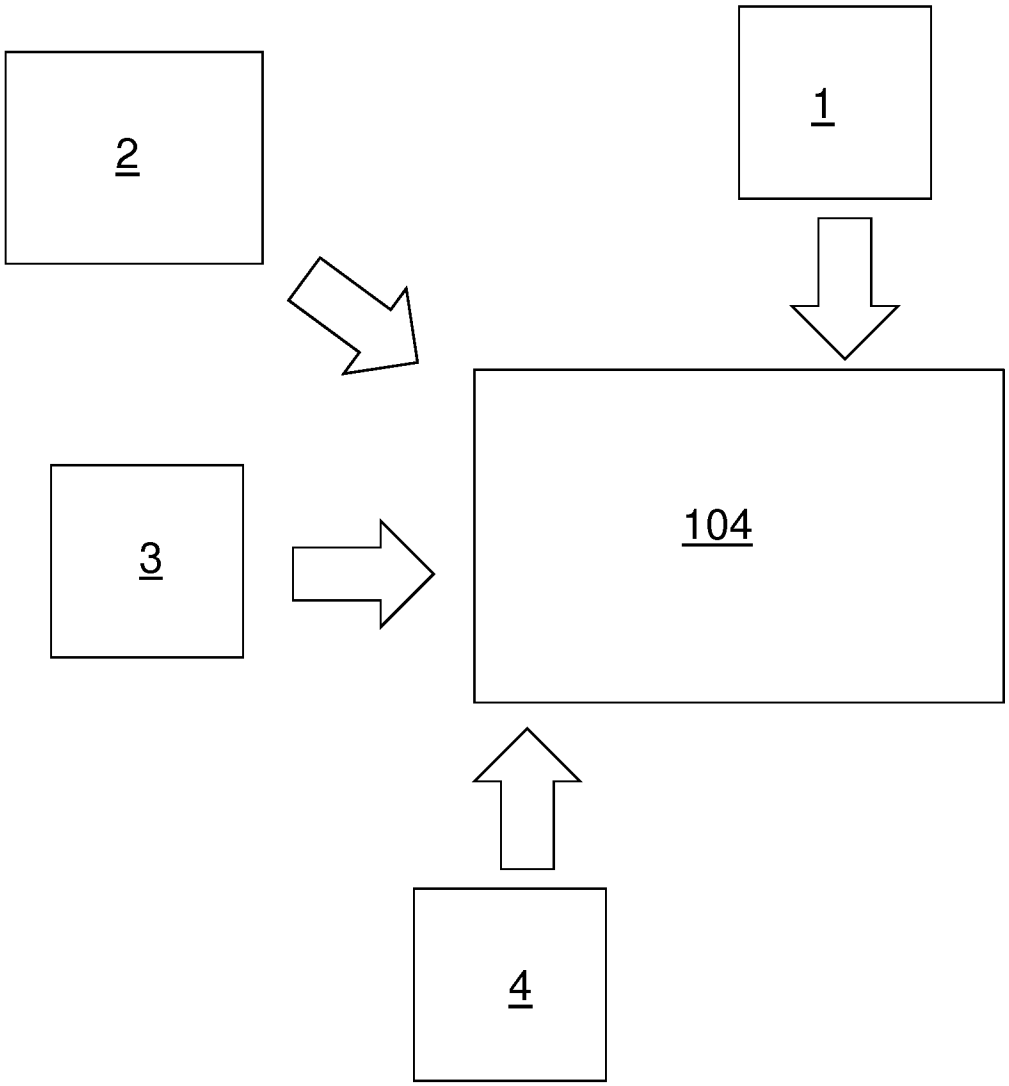
FIG. 2 shows a block diagram of a variant of the method of FIG. 1.

In FIG. 2, the introduction of the various tobacco types during the blending step 104 is shown.

It is to be understood that each tobacco type could be itself a sub-blend, in other words, the "bright tobacco type" could be for example a blend of Virginia tobacco and Brazil flue-cured tobacco of different grades.

After the blending step 104, a fine grinding step 105, to a tobacco powder mean size of between about 0.03 millimetres and about 0.12 millimetres is performed. This fine grinding step 105 reduces the size of the tobacco down to a powder size suitable for the slurry preparation. After this fine grinding step 105, the cells of the tobacco are at least partially destroyed and the tobacco powder may become sticky.

The so obtained tobacco powder can be immediately used to form the tobacco slurry. Alternatively, a further step of storage of the tobacco powder, for example in suitable containers may be inserted (not shown).

Figure 3:
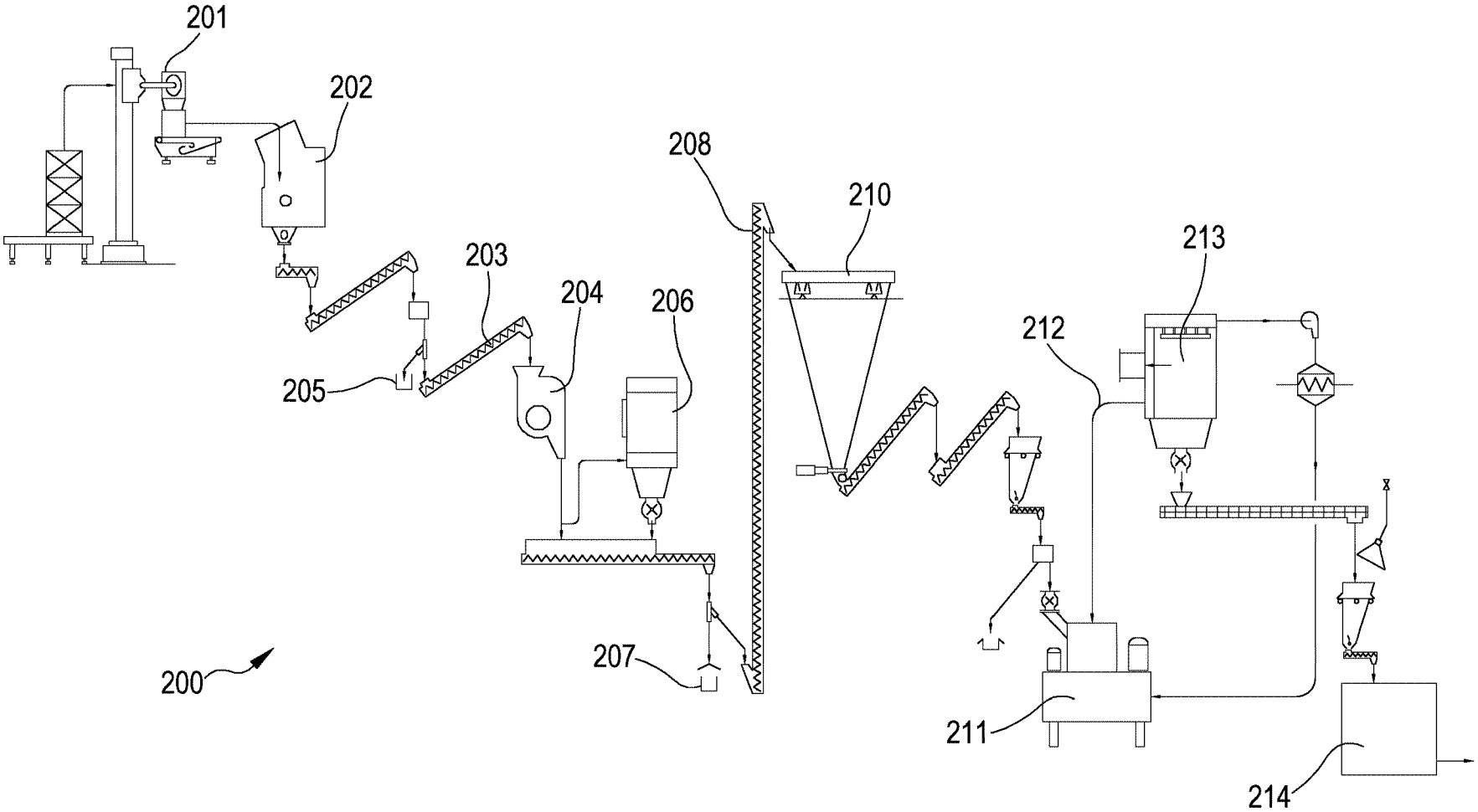
FIG. 3 shows a block diagram of a method for production of a homogenized tobacco material according to the invention.

The steps of tobacco blending and grinding tobacco for the formation of a homogenized tobacco material according to FIG. 1 are performed using an apparatus for the grinding and blending of tobacco 200 depicted schematically in FIG. 3. The apparatus 200 includes a tobacco receiving station 201, where accumulating, de-stacking, weighing and inspecting the different tobacco types takes place. Optionally, in case the tobacco has been shipped into cartons, in the receiving station 201 removal of cartons containing the tobacco is performed. The tobacco receiving station 201 also optionally comprises a tobacco bale splitting unit.

In FIG. 3 only a production line for one type of tobacco is shown, but the same equipment may be present for each tobacco type used in the homogenised tobacco material web according to the invention, depending on when the step of blending is performed. Further the tobacco is introduced in a shredder 202 for the shredding step 103. Shredder 202 can be for example a pin shredder. The shredder 202 is preferably adapted to handle all sizes of bales, to loosen tobacco strips and shred strips into smaller pieces. The shreds of tobacco in each production line are transported, for example by means of pneumatic transport 203, to a mill 204 for the coarse grinding step 102. Preferably a control is made during the transport so as to reject foreign material in the tobacco shreds. For example, along the pneumatic transport of shredded tobacco, a string removal conveyor system, heavy particle separator and metal detector may be present, all indicated with 205 in the appended drawing.

Mill 204 is adapted to coarse grind the tobacco strips up to a size of between about 0.25 millimetres and about 2 millimetres. The rotor speed of the mill can be controlled and changed on the basis of the tobacco shreds flow rate.

Preferably, a buffer silo 206 for uniform mass flow control, is located after the coarse grinder mill 204. Furthermore, preferably mill 204 is equipped with spark detectors and safety shut down system 207 for safety reasons.

From the mill 204, the tobacco particles are transported, for example by means of a pneumatic transport 208, to a blender 210. Blender 210 preferably includes a silo in which an appropriate valve control system is present. In the blender, all tobacco particles of all the different types of tobacco which have been selected for the predetermined blend are introduced. In the blender 210, the tobacco particles are mixed to a uniform blend. From the blender 210, the blend of tobacco particles is transported to a fine grinding station 211.

Fine grinding station 211 is for example an impact classifying mill with suitable designed ancillary equipment to produce fine tobacco powder to the right specifications, that is, to a tobacco powder between about 0.03 millimetres and about 0.12 millimetres. After the fine grinding station 211, a pneumatic transfer line 212 is adapted to transporting the fine tobacco powder to a buffer powder silo 213 for continuous feed to a downstream slurry batch mixing tank where the slurry preparation process takes place.

The method for the production of a homogenized tobacco material of FIG. 1 further includes a step of suspension preparation 106. The suspension preparation step 106 preferably comprises mixing an aerosol-former 5 and a binder 6 in order to form a suspension. Preferably, the aerosol—former 5 comprises glycerol and the binder 6 comprises guar.

The step of forming a suspension 106 of binder in aerosol-former includes the steps of loading the aerosol-former 5 and the binder 6 in a container and mixing the two. Preferably, the resulting suspension is then stored before being introduced in the slurry. Preferably, the glycerol is added to the guar in two steps, a first amount of glycerol is mixed with guar and a second amount of glycerol is then injected in the transport pipes, so that glycerol is used to clean the processing line, avoiding hard-to-clean points within the line.

Figure 4:
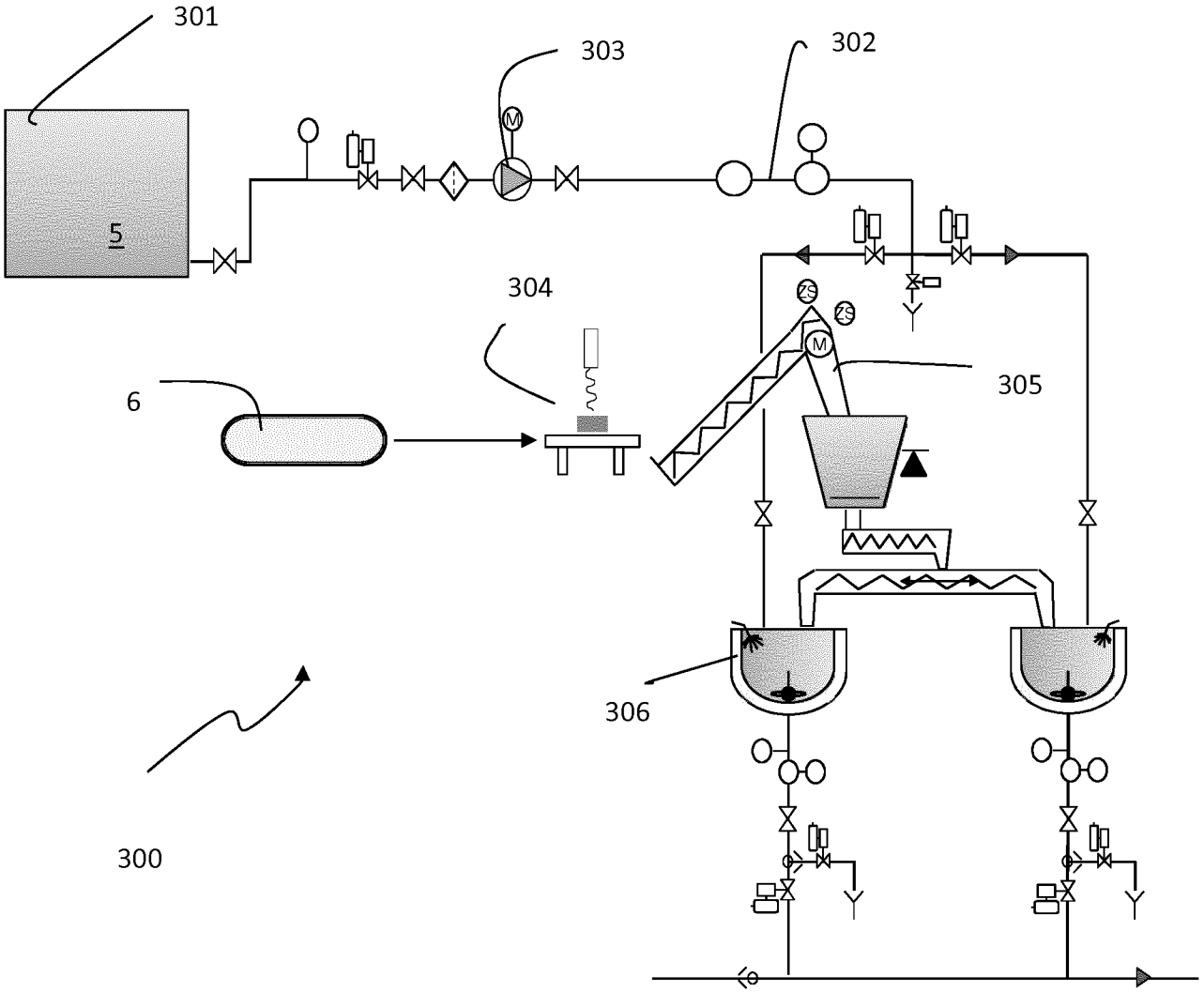
FIG. 4 shows an enlarged view of one of the steps of the method of FIG. 1, 2 or 3.

A slurry preparation line 300 adapted to perform the suspension of binder in aerosol-former as per step 106 of the invention is depicted in FIG. 4.

The slurry preparation line 300 includes an aerosol-former, such as glycerol, bulk tank 301 and a pipe transfer system 302 having a mass flow control system 303 adapted to transfer the aerosol-former 5 from the tank 301 and to control its flow rate. Further, the slurry preparation line 300 comprises a binder handling station 304 and a pneumatic transport and dosing system 305 to transport and weight the binder 6 received at the station 304.

Aerosol-former 5 and binder 6 from tank 301 and handling station 304, respectively, are transported to a mixing tank, or more than a mixing tank, 306, part of the slurry preparation line 300, designed to mix binder 6 and aerosol-former 5 uniformly.

The method to realize the homogenized tobacco material includes a step of preparing a cellulose pulp 107. The pulp preparation step 107 preferably comprises mixing cellulose fibres 7 and water 8 in a concentrated form, optionally storing the pulp so obtained and then diluting the concentrated pulp before forming the slurry. The cellulose fibres, for example in boards or bags, are loaded in a pulper and then liquefied with water. The resulting water—cellulose solution may be stored at different densities, however preferably the pulp which is the result of the step 107 is "concentrate". Preferably, "concentrate" means that the total amount in the cellulose fibres in the pulp is between about 3 percent and 5 percent of the total pulp weight before dilution. Preferred cellulose fibres are soft wood fibres. Preferably, the total amount of cellulose fibres in the slurry in dry weight is between about 1 percent and about 3 percent, preferably, between about 1.2 percent and about 2.4 percent in dry weight of the slurry.

Preferably, the step of mixing of water and cellulose fibres lasts between about 20 and about 60 minutes, advantageously at a temperature comprised between about 15 degrees Celsius and about 40 degrees Celsius.

The storage time, if storage of the pulp is performed, may preferably vary between about 0.1 day and about 7 days.

Advantageously, water dilution takes place after the step of storing of the concentrated pulp. Water is added to the concentrated pulp in such an amount that the cellulose fibres are less than about 1 percent of the total weight of the pulp. For example a dilution of a factor comprised between about 3 and about 20 can take place.

Further, an additional step of mixing may take place, which comprises mixing the concentrated pulp and the added water. The additional mixing step preferably lasts between about 120 minutes and about 180 minutes at a temperature between about 15 degrees Celsius and about 40 degrees Celsius, more preferably at a temperature of between about 18 degrees Celsius and about 25 degrees Celsius.

All tanks and transfer pipes for cellulose fiber, guar and glycerol are preferably designed to be as optimally short as possible to reduce transfer time, minimize waste, avoid cross contamination and facilitate ease of cleaning. Further, preferably, the transfer pipes for cellulose fiber, guar and glycerol are as straight as possible, to allow a swift and uninterrupted flow. In particular for the suspension of binder in the aerosol-former, turns in the transfer pipe could otherwise result in areas of low flow rate or even standstill, which in turn can be areas where gelling can occur and with that potentially blockages within the transfer pipes. As mentioned before, those blockages can lead to the need for cleaning and standstill of the entire manufacturing process.

Preferably, after the step of pulp preparation 107, an optional step of fibres' fibrillation is performed (not depicted in FIG. 1).

Figure 5:
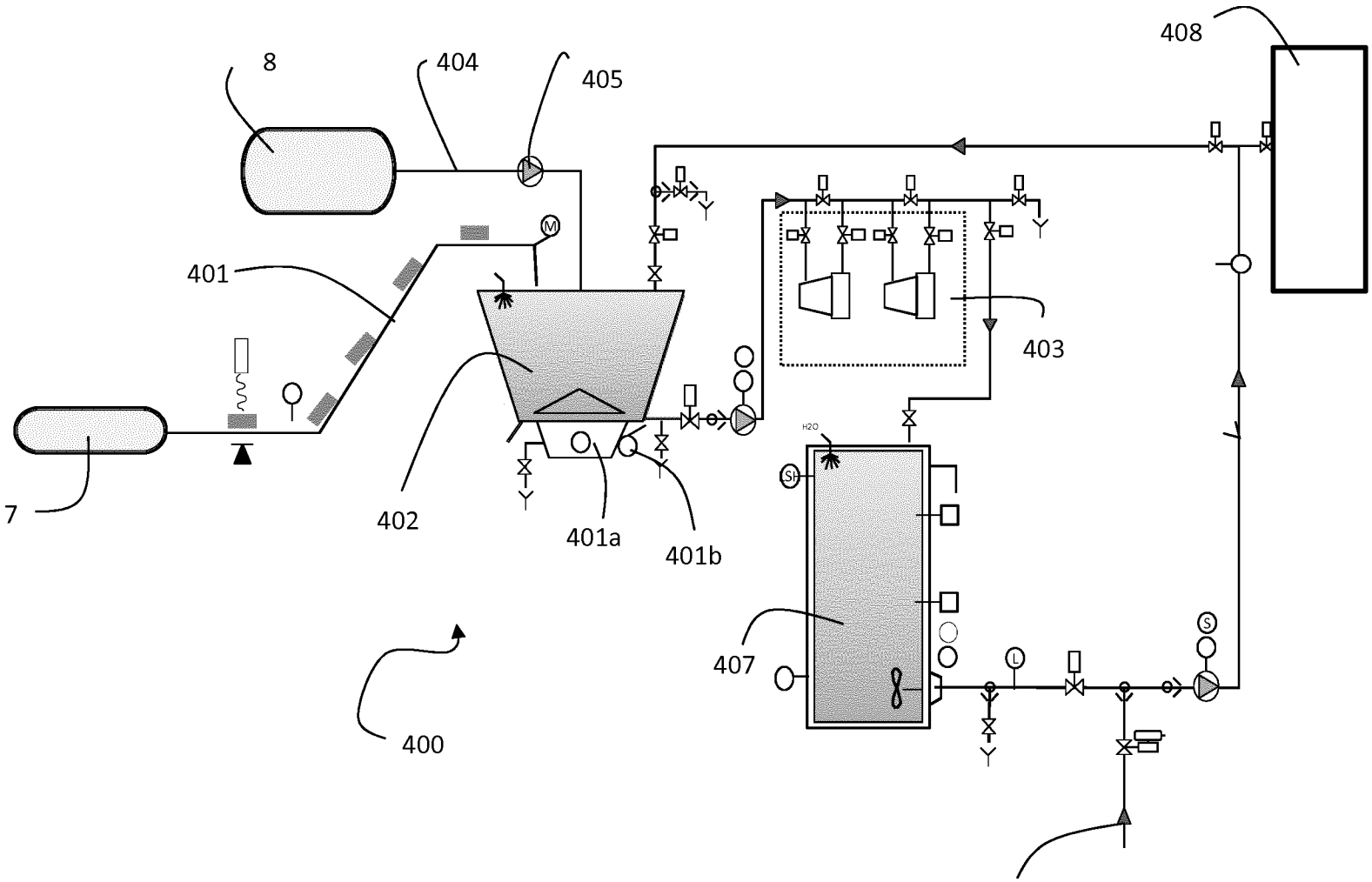
FIG. 5 shows an enlarged view of one of the steps of the method of FIG. 1, 2 or 3.

An apparatus 400 to perform the method step 107 of the pulp formation is depicted in FIG. 5. FIG. 5 schematically depicts a cellulose fibre feeding and preparation line 400 comprising a feeding system 401, preferably adapted to handle cellulose fibres 7 in bulk form, such as board/sheets or fluffed fibres, and a pulper 402. The feeding system 401 is adapted to direct the cellulose fibres to the pulper 402, which is in turn adapted to disperse the received fibres uniformly.

The pulper 402 includes a temperature control unit 401*a* so that the temperature in the pulper is kept within a given temperature interval, and a rotational speed control unit 401*b*, so that the speed of an impeller (not shown) present in the pulper 402 is controlled and kept preferably comprised between about 5 rpm and about 35 rpm.

The cellulose fibre feeding and preparation line 400 further comprises a water line 404 adapted to introduce water 8 in the pulper 402. A flow rate controller 405 to control the flow rate of water introduced in pulper 402 is preferably added in the water line 404.

The cellulose fibre feeding and preparation line 400 may also further comprise a fibre refiner system 403 to treat and fibrillate fibres, so that long fibres and nested fibres are removed, and a uniform fibre distribution is obtained.

Preferably, the mean size of the cellulose fibres at the end of the pulping and refining step is comprised between about 0.2 millimetres and about 4 millimetres, more preferably between about 1 millimetre and about 3 millimetres.

The mean size is considered to be the mean length. Each length of the fiber is calculated following the framework of the fiber, therefore it is the real developed length of the fiber. The mean fiber length is calculated per number of fibers, for example it may be calculated on 5.000 fibers.

Measured objects are considered as fibers if their length and width are comprised within:

$200<\square<10{,}000$ $5<\square<75$

In order to calculate the mean fiber length, the MorFi Compact fiber analyzer on fibers produced by TechPap SAS can be used.

The analysis is performed for example putting the fibers in a solution, so as to form an aqueous fibrous suspension. Preferably, deionized water is used and no mechanical mixing is applied during sample preparation. Mixing is performed by the fiber analyzer. Preferably, measurements are performed on fibers which have stayed at least 24 hours at about 22 degrees Celsius and about 50 percent relative humidity.

Downstream the fibre refiner system 403, the cellulose fibre feeding and preparation line 400 may comprise a cellulose buffer tank 407 connected to the fibre refiner system 403 to store the high consistency fibre solution coming out of the system 403.

At the end of cellulose fibre feeding and preparation line 400, a cellulose dilution tank 408 in which pulp is diluted is preferably present and connected to cellulose buffer tank 407. The cellulose dilution tank 408 is adapted to batch out cellulose fibres of right consistency for subsequent slurry mixing. Water for dilution is introduced in tank 408 via a second water line 410.

The method to form a slurry according to the invention further comprises a step of slurry formation 108, where the suspension 9 of binder in aerosol-former obtained in step 106, the pulp 10 obtained in step 107 and the tobacco powder blend 11 obtained in step 104 are combined together.

Preferably, the step of slurry formation 108 comprises first a step of introduction in a tank of the suspension 9 of binder in aerosol-former and of the cellulose pulp 10. Afterwards, the tobacco powder blend 11 is introduced as well. Preferably, the suspension 9, the pulp 10 and the tobacco powder blend 11 are suitably dosed in order to control the amount of each of them introduced in the tank. The slurry is prepared according to specific proportion among its ingredients. Optionally, also water 8 is added as well.

Preferably, the step of slurry formation 108 also comprises a mixing step, where all the slurry ingredients are mixed together for a fixed amount of time. In a further step of the method according to the invention, the slurry is then transferred to a following casting step 109 and drying step 110.

Figure 6:
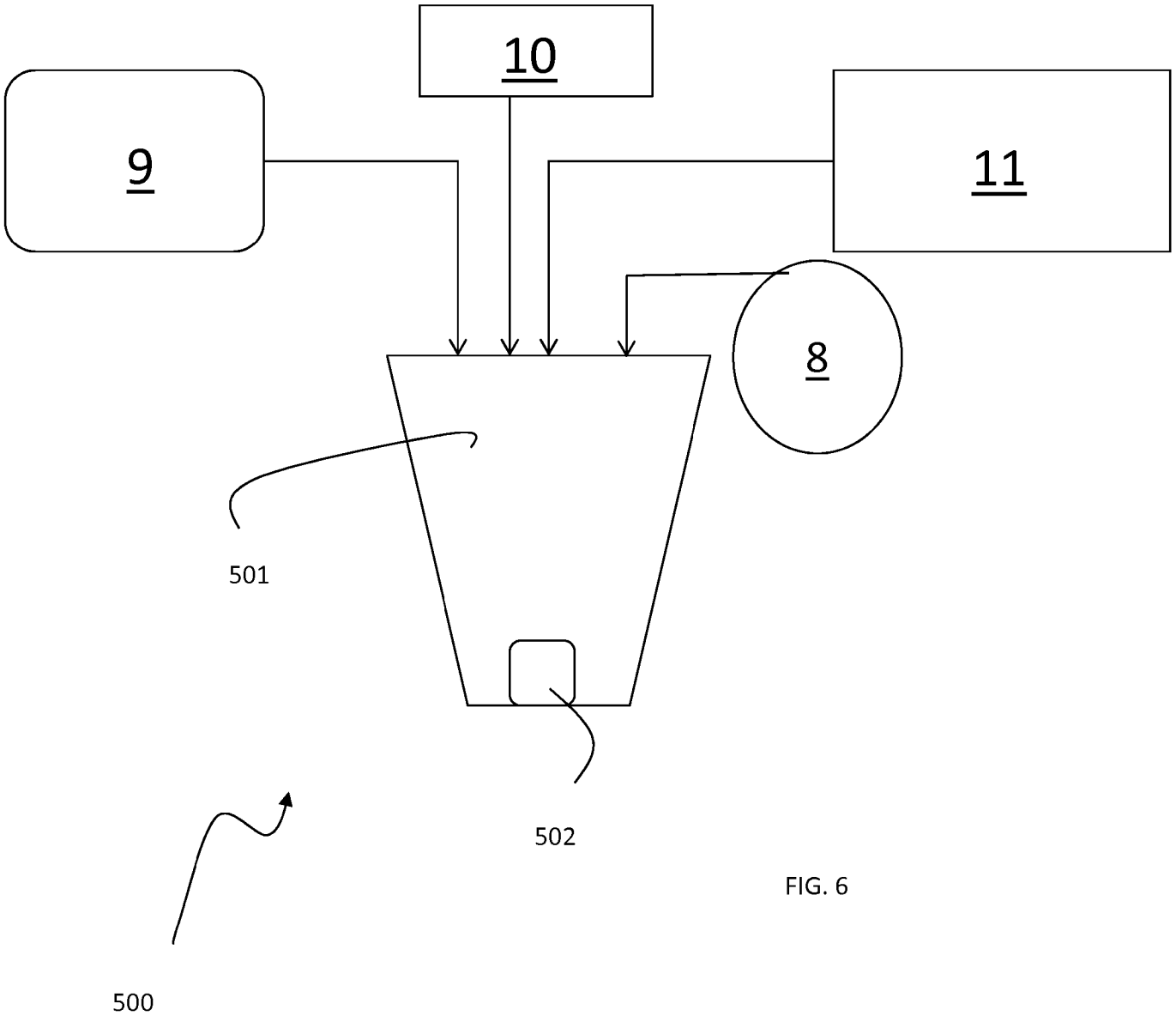
FIG. 6 shows a schematic view of an apparatus for performing the method of FIGS. 1 and 2.

An apparatus 500 for the slurry formation adapted to realize step 108 of the method of the invention is schematically depicted in FIG. 6. Apparatus 500 includes a mixing tank 501 where cellulose pulp 10 and suspension 9 of binder in aerosol-former are introduced. Further, the tobacco powder blend 11 from the blending and grinding line is fine-ground and dosed into the mixing tank 501 in specified quantity to prepare the slurry.

For example, the tobacco powder blend 11 may be contained in a tobacco fine powder buffer storage silo to ensure continuous upstream powder operation and meeting demand of slurry mixing process. Tobacco powder is transferred to the mixing tank 501 preferably by means of a pneumatic transfer system (not shown).

The apparatus 500 further comprises preferably a powder dosing/weighing system (also not shown) to dose required amount of the slurry's ingredients. For example, the tobacco powder may be weighted by a scale (not shown) or weighting belt (not shown) for precise dosing. The mixing tank 501 is specially designed to mix the dry and liquid ingredients to form a homogenous slurry. The slurry mixing tank preferably comprises a cooler (not shown), such as water jacket wall to allow water cooled on the external walls of the mixing tank 501. The slurry mixing tank 501 is further equipped with one or more sensors (not shown) such as a level sensor, a temperature probe and a sampling port for control and monitoring purpose. Mixing tank 501 has an impeller 502 adapted to ensure uniform mixing of the slurry, in particular adapted to transfer slurry form the external walls of the tank to the internal part of the tank or vice-versa. The speed of the impeller can be preferably controlled by means of a dedicated controlling unit. Mixing tank 501 also includes a water line for the introduction of water 8 at a controlled flow rate.

Preferably, mixing tank 501 includes two separated tanks, one downstream to the other in the flow of slurry, one tank for preparing the slurry and the second tank with slurry for transfer to provide continuous slurry supply to a casting station.

The method of the invention to produce a homogenized tobacco web includes further a casting step 109 in which the slurry prepared in step 108 is cast in a continuous tobacco web onto a support. The casting step 109 includes transferring the slurry from the mixing tank 501 to a casting box. Further, it preferably includes monitoring the level of slurry in the casting box and the moisture of the slurry. Then, the casting step 109 includes casting, preferably by means of a casting blade, the slurry onto a support, such as a steel conveyor. Further, in order to obtain a final homogenized tobacco web for the use in an aerosol-formed article, the method of the invention includes a drying step 110 in which the cast web of homogenized tobacco material is preferably dried. The drying step 110 includes drying the cast web, by means of steam and heated air.

Preferably the drying with steam is performed on the side of the cast web in contact with the support, while the drying with heated air is performed on the free side of the cast web.

Figure 7:
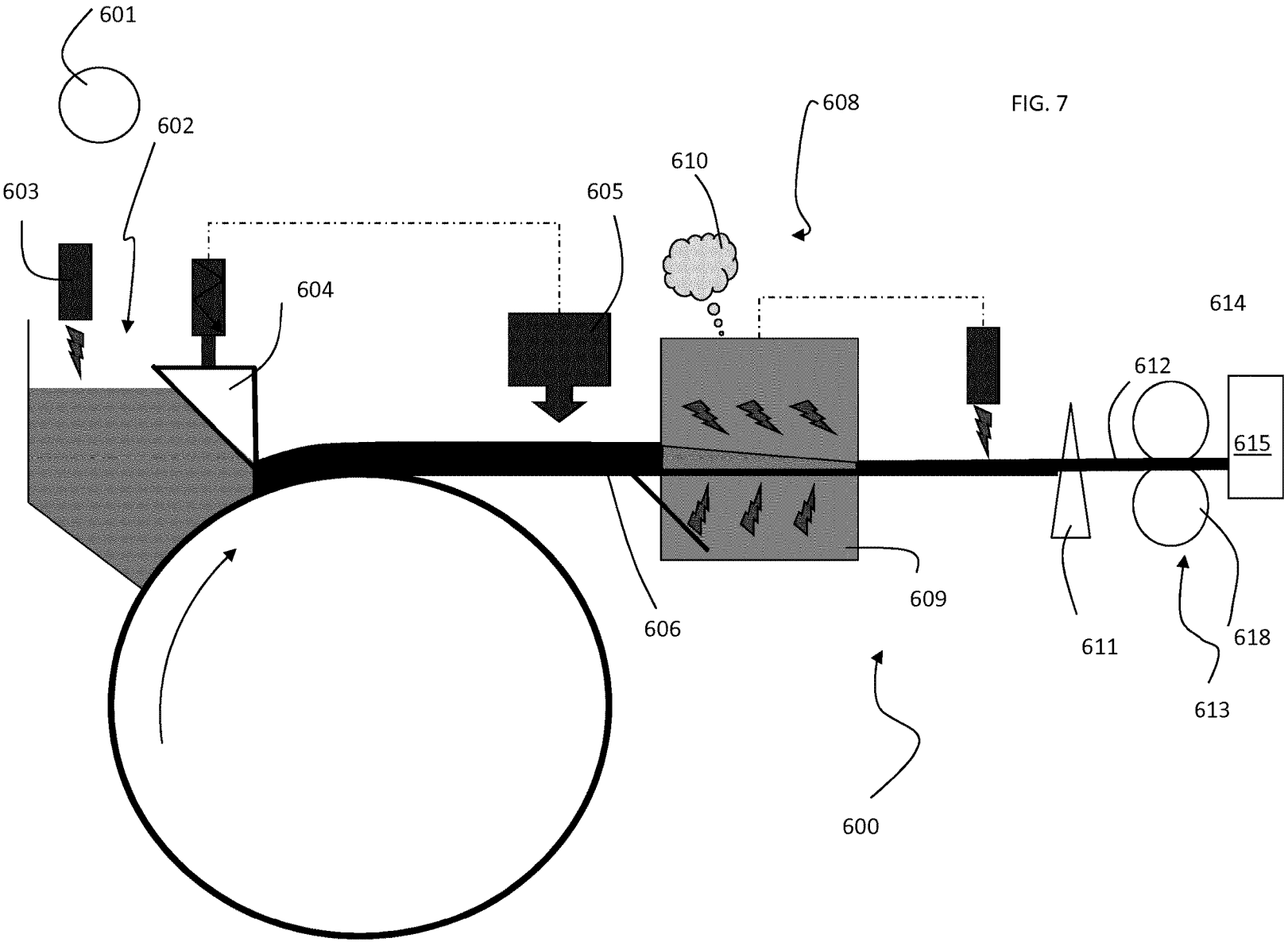
FIG. 7 shows a schematic view of an apparatus for performing the method of FIG. 3.

An apparatus for performing the steps of casting 109 and drying 110 is schematically depicted in FIG. 7. The casting and drying apparatus 600 includes a slurry transfer system 601, such as a pump, preferably having a flow control, and a casting box 602 to which the slurry is transferred by the pump. Preferably, casting box 602 is equipped with level control 603 and a casting blade 604 for the casting of the slurry into a continuous web of homogenized tobacco material. Casting box 602 may also comprise a density control device 605 to control the density of the cast web.

A support, such as a stainless steel belt conveyor 606, receives the slurry cast by the casting blade 604. The width of the slurry at casting forming a cast web is of about 1.93 meters.

Casting and drying apparatus 600 also includes a drying station 608 to dry the cast web of slurry. Drying station 608 comprises a steam heating 609 and top air drying 610.

The cast web goes preferably through a secondary drying process to remove further moisture content of the web to reach moisture target or specification. The width of the cast web after drying is preferably of about 1.8 meters.

Figure 8:
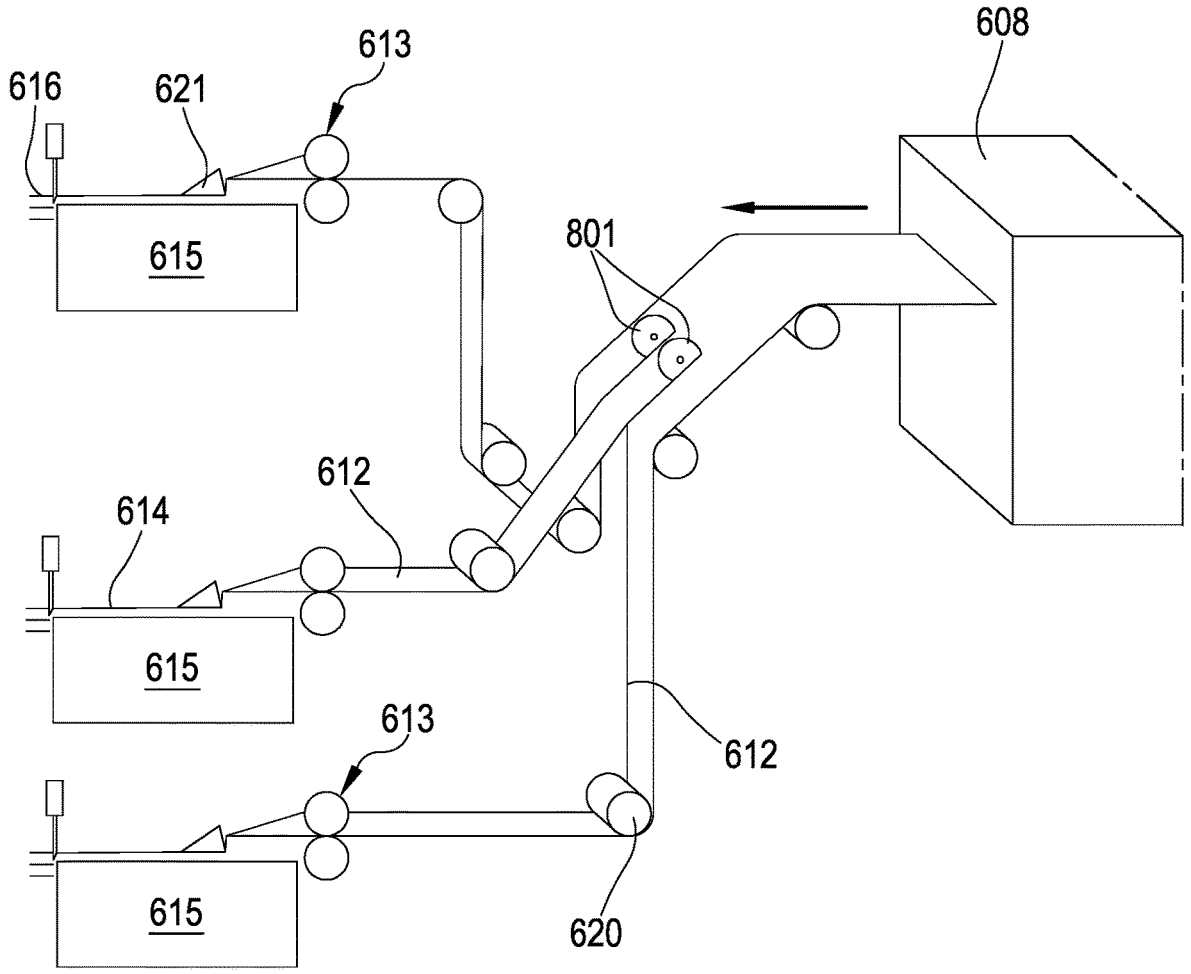
FIG. 8 shows a schematic view of a portion of the apparatus for performing the method of FIG. 3.

After the drying step 110, the cast web is preferably cut in one or more portioned homogenized tobacco sheets in a slitting step 111, for example to form three portioned parallel webs 612, as shown in FIGS. 7 and 8. The cutting is performed by means of a slitter 611 including one or more blade, such as two blades 801 in the example of FIG. 8. The support 606 moves the cast web from the drying station 608 directly to the slitter 611. Preferably, the width of the portioned cast webs after slitting is comprised between about 0.05 meters and about 0.5 meters, more preferably the width is of about 0.125 meters. After the slitting step 111, the portioned webs 612 are each crimped by means of a crimper 613, in a crimping step 112. Each portioned web 612 is preferably crimped in a different crimper 613, such as the three crimpers shown in FIG. 8.

Each crimper 613 preferably comprises a pair of rotatable crimping rollers 618. In use, the continuous portioned sheet of homogenized tobacco 612 is transported downstream the slitter 611 to the pair of crimping rollers 618 by the transport mechanism via a series of guide and tensioning rollers 620. As the continuous portioned sheet of homogenized tobacco 612 is fed between the pair of crimping rollers 618, the crimping rollers engage and crimp the sheet 612 to form a continuous crimped sheet of homogenised tobacco having a plurality of spaced-apart ridges or corrugations substantially parallel to the longitudinal axis of the sheet through the apparatus.

Figure 9:
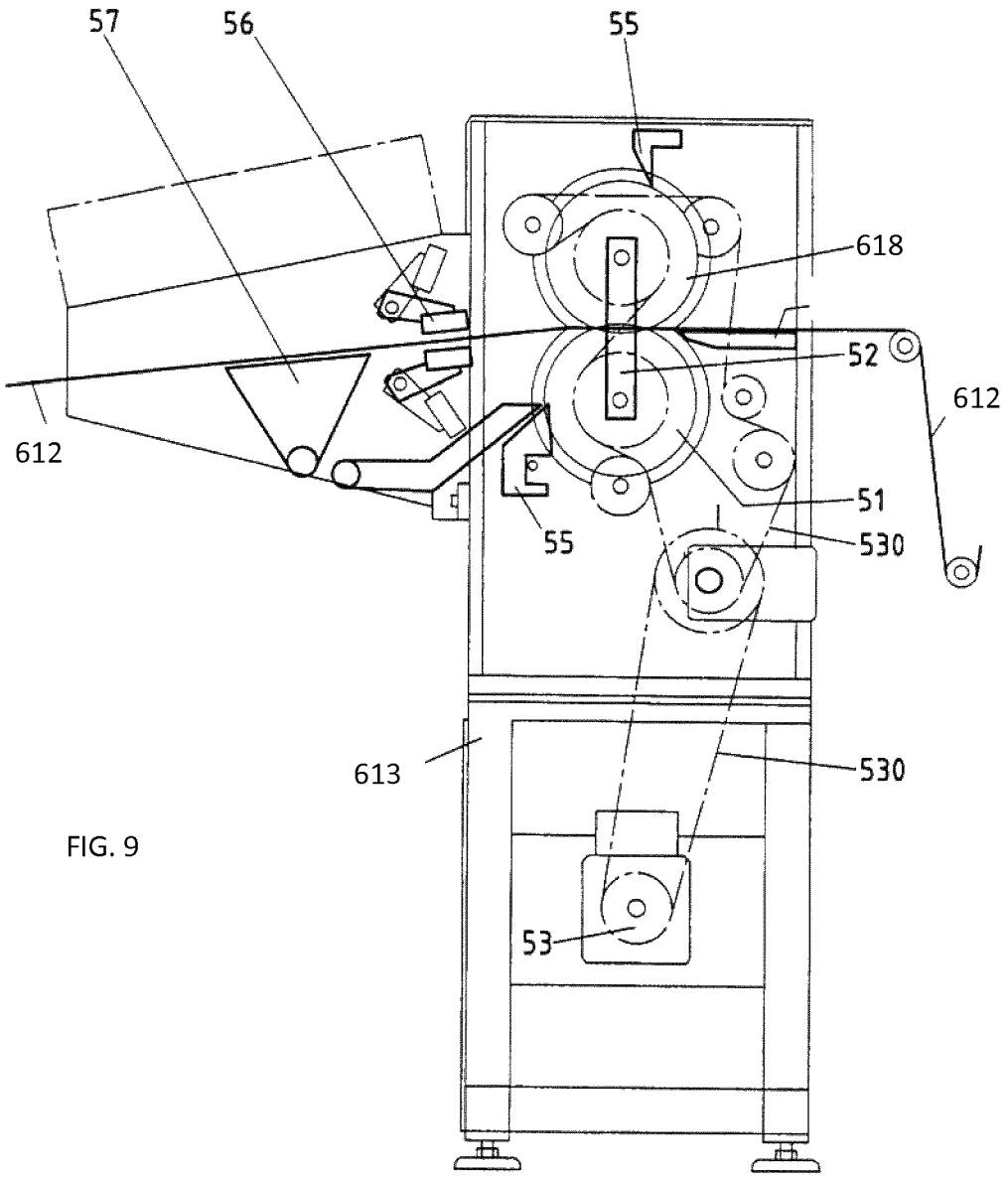
FIG. 9 shows an enlarged view of a detail of the apparatus of FIG. 5.

FIG. 9 shows an embodiment of crimper 613. The crimper is disposed immediately downstream of the slitter 611, which has just been described. It essentially comprises a frame 50 on which the two crimping rollers 618 are mounted to crimp while rotating. Each crimping roller 618 consists of a cylinder whose circumferential surface is machined to different diameters, so as to have a relief profile and successive grooves. The two rollers 618 are mounted parallel to each other so that the projections and grooves of a roller profile correspond to the grooves and the other roller of the relief profile. Spacer means, shown schematically at 52 in the FIG. 9 to adjust the distance between the axes of the two rollers in order to control the interpenetration of reliefs hollow profiles and the outer surfaces of the two rollers 618. By varying this distance, it is thus vary the rate of crimping of the portioned cast the web 612 passing between the two crimping rollers 618.

The setting value of the crimping rate is adjusted manually, the setting itself of the spacing between the two two crimping rollers being done manually or by motorized means, or automated.

The driving of the rollers 618 is performed via a variable speed motor means 53, for example an electric motor driving the two rollers through a set of belts 530, so that both crimping rollers 618 rotate at the same speed for crimping the portioned cast web 612 which passes between them.

The crimping operation of the portioned cast web 612 may produce dust. The crimper 613 is therefore advantageously provided with a cleaning device 55 of each of the crimping rollers to prevent their fouling.

To prevent dust from adhering to the crimped portioned cast web 612, an ionization module 56 can be provided, in a known manner, preceding a suction module 57 charged to suck dust when the crimped cast web 612 leaves the crimper 613.

The continuous crimped sheet of homogenized tobacco material exiting the crimper 613 is transported downstream from the pair of crimping rollers 618 towards a rod forming means 615.

The rod forming means 615 are used for gathering the continuous crimped sheet and circumscribing the gathered material with a wrapper (not shown) to form a continuous rod. The apparatus also comprises transport means for transporting the continuous portioned sheet 612 of material downstream through the apparatus from the slitter to the rod forming means via the crimpers 613.

The crimped sheets are preferably fed to the rod forming means 615 through a converging funnel or horn 621. The converging funnel 621 gathers the continuous crimped sheet of homogenized tobacco transversely relative to its longitudinal axes. The sheet of material assumes a substantially cylindrical configuration as it passes through the converging funnel 621. Upon exiting the converging funnel 621, the gathered sheet of homogenized tobacco may be wrapped in a continuous sheet of wrapping material (not shown).

Further the apparatus preferably comprises cutting means 616 for severing the continuous rod, which may be wrapped or non wrapped, in a plurality of discrete rods (not visible in the drawings).

The so formed rods may then be used for the production of an aerosol-generating article (not shown).

The invention claimed is:

1. A method for inline production of homogenized tobacco material, said method comprising:

preparing a slurry comprising tobacco powder blend, a binder and an aerosol former in an aqueous medium, comprising:

pre-mixing a binder in an aerosol former to form a suspension to control viscosity of the slurry;

creating a cellulose pulp from cellulose fibers and water;

providing a tobacco powder blend; and combining the suspension, the cellulose pulp, and the tobacco powder blend to form the slurry;

casting the slurry in a support movable along a transport direction;

drying the cast slurry to form a homogenized tobacco sheet;

slitting in a slitter the homogenized tobacco sheet along said transport direction while the homogenized tobacco sheet is moved along the transport direction so as to form at least two portioned homogenized tobacco sheets; and crimping the at least two portioned homogenized tobacco sheets in parallel as received from the slitter, wherein the suspension between aerosol-former and binder is performed when the water content of the suspension of binder in aerosol-former is less than about 1 percent of the total weight of the suspension.

2. The method according to claim 1, including:

forming a rod from each crimped portioned homogenized tobacco sheet.

3. The method according to claim 1, wherein the step of slitting the homogenized tobacco sheet includes the step of slitting the homogenized tobacco sheet in at least three portioned homogenized tobacco sheets.

4. The method according to claim 1, wherein the step of preparing a slurry comprises:

pulping and refining cellulose fibres to obtain fibres having a mean size comprised between about 0.2 millimetres and about 4 millimetres;

grinding a blend of tobacco of one or more tobacco types to a tobacco powder having a mean size comprised between about 0.03 millimetres and about 0.12 millimetres;

combining the pulp with the tobacco powder blend of different tobacco types and with a binder in an amount comprised between about 1 percent and about 5 percent in dry weight basis of the total weight of the homogenized tobacco material, so as to form a slurry; and homogenizing the slurry.

5. The method according to claim 1, including receiving the at least two portioned homogenized tobacco sheets from the slitter by at least two crimpers that are distanced from each other vertically.

* * * * *